US006865998B2

(12) United States Patent
Darling et al.

(10) Patent No.: US 6,865,998 B2
(45) Date of Patent: Mar. 15, 2005

(54) BOAT HOOK ATTACHMENT

(76) Inventors: Garritt A. Darling, 9035 SE. Bobwhite St., Hobe Sound, FL (US) 33455; Irene L. Olson, 9035 SE. Bobwhite St., Hobe Sound, FL (US) 33455

( * ) Notice: Subject to any disclaimer, the term of this patent is extended or adjusted under 35 U.S.C. 154(b) by 0 days.

(21) Appl. No.: 10/607,160

(22) Filed: Jun. 24, 2003

(65) Prior Publication Data

US 2004/0069200 A1 Apr. 15, 2004

Related U.S. Application Data

(63) Continuation-in-part of application No. 10/268,588, filed on Oct. 9, 2002, now Pat. No. 6,739,275.

(51) Int. Cl.[7] ..... B63B 9/00
(52) U.S. Cl. ..... 114/221 R
(58) Field of Search ..... 114/221 R, 230.25

(56) References Cited

U.S. PATENT DOCUMENTS

| | | | | | |
|---|---|---|---|---|---|
| 3,841,685 | A | | 10/1974 | Kolodziej | |
| 4,009,181 | A | | 2/1977 | Berger et al. | |
| 4,261,280 | A | * | 4/1981 | Collic, Sr. | 114/221 R |
| 4,986,207 | A | * | 1/1991 | Reed | 114/221 R |
| 5,699,748 | A | | 12/1997 | Linskey, Jr. et al. | |
| 5,946,844 | A | * | 9/1999 | Stoliar et al. | 43/17.2 |

* cited by examiner

*Primary Examiner*—Stephen Avila
(74) *Attorney, Agent, or Firm*—McHale & Slavin, P.A.

(57) ABSTRACT

A boat hook and line handling device designed to facilitate positioning and handling of a mooring or docking line during a boat docking operation is removably mounted on an extendable pole. The device has a clip with an elongated body and a free end. An attachment connects the clip with the boat hook shaft and encircles the shaft of the boat hook. A docking line may be wedged between the clip and the shaft of the boat hook to form a loop to engage a piling.

6 Claims, 6 Drawing Sheets

BOAT HOOK ATTACHMENT

RELATED APPLICATIONS

This application is a continuation in part of U.S. application Ser. No. 10/268,588 filed Oct. 9, 2002 now U.S. Pat. No. 6,739,275, issued May 25, 2003, the contents of which are incorporated by reference.

FIELD OF THE INVENTION

This invention relates to nautical line handling devices, and more particularly to an improved boat hook with an integral clamp for handling and positioning mooring lines.

BACKGROUND OF THE INVENTION

The present invention relates to boat hooks for the purpose of providing an improved arrangement for positioning an end loop of a boat line around a piling, cleat, or other fixed object.

In the hands of a capable captain, a boat traveling at moderate speeds in open water is considered to be relatively safe from damage. However, as a boat approaches a dock or slip, the boat will lose a great deal of maneuverability since water flow past the boat rudders is greatly reduced. During this time, the boat is at a high risk of damage should wind, waves or current cause undirected movement of the boat. For this reason, it is critical that the boat is secured to a fixed object as quickly as possible.

By way of illustration, a common means for securing a boat is by attachment to a piling. A piling is typically a large wood or cement column embedded in the earth beneath the water body. A free end of a line is formed into a loop and placed around the piling, with the opposite end secured to the boat. A problem, which this invention addresses, is the difficulty in placing the looped end of the line around the piling. Some boaters attempt to throw the loop, lasso-style, while others rely on a second crew member for assistance. Still other boaters employ a line handling device to place the looped end of the mooring line around a piling or cleat. Unfortunately, current line handling devices have many shortcomings.

For example, U.S. Pat. No. 3,841,685 discloses a line handling device designed to secure a mooring line to a piling. The device uses a slotted circle to lower a loop of line around a piling. Unfortunately, this device is not adjustable and, therefore, only works on pilings which fit within its preset dimensions.

Some line handling devices, like U.S. Pat. No. 4,004,539 and U.S. Pat. No. 5,699,748, were designed with large frames to accommodate pilings of various sizes. These line handling devices were found to work with a wide variety of pilings, but they also created new problems: they were hard to store and required two-handed control of the device. This two-handed line handling operation thereby reduced the boater's ability to use his or her hands to control the boat during docking.

Accordingly, one-handed line handling devices were developed. U.S. Pat. No. 4,009,181 discloses a line handling device which places line-stiffening members onto the looped end of a mooring line. This device allows one-handed placement of a line, but poses preparation problems. For example, based on weather or water currents, different numbers of mooring lines may be required during different docking sessions.

Accordingly, what is needed in the art is a boat hook and line handling device that may be quickly, conveniently, and effectively used to accommodate a variety of dock pilings or cleats, and should also be is easy to store.

SUMMARY OF THE INVENTION

The present invention is a line handling device used to facilitate the handling of a mooring line when a user is securing a boat to a dock or piling. The device employs a clip connected to one end of an extendable pole, such as a conventional boat hook. When attached to the handle, the clip forms a biased slot between the handle and the clip in which a docking line may be frictionally secured.

The distal end of the boat hook provides support for the loop end of a mooring line which has been draped around the outside contours of the hook portion. A length of line greater than the distance between the hook and the clip extends back along the handle to the clip. The line is secured between the clip and the handle to keep the loop in place.

The line handling device is used during the securing of a boat to help a user place and secure the loop end of a mooring line around a piling or dock cleat. First, the user adjusts the loop end of the mooring line to create a loop having a greater outer dimension than the piling or docking cleat. Next, the user rests the loop on the hook portion of the boat hook, positioning the line between the shaft of the handle end of the hook. Extra length of line is then led back to and secured in the clip. This shapes the loop so that it may be lowered around a piling or dock cleat which is within reach of the extendable pole. The user then lowers the supported loop end of the mooring line around the cleat or piling. Using a horizontal motion, the user pulls the device away from the cleat or piling. As the device is drawn towards the user, the mooring line's adjustable loop will engage the cleat or piling and become separated from the boat hook. The loop may then be drawn tight about the cleat or piling by pulling on the mooring line's non-looped end.

After use, the line handling clip may be broken down for storage by removing the clip from the extendable pole. IN one embodiment, the clip is attached to the pole by a releasable spring biased fastening. In another embodiment, the clip is be mounted internally in the boat hook. The clip is usually oriented parallel with the longitudinal axis of the pole and may remain connected to the pole, if desired.

Accordingly, it is an object of the present invention to provide a line handling device that facilitates the handling and securing of a mooring line, without requiring special preparation or alteration of the line.

Yet another object of the present invention is to provide a line handling device that facilitates the handling and securing of a mooring line, the device being self-contained and having no components which separate from the device during use.

A further object of the present invention is to provide a line handling device that facilitates the handling and securing of a mooring line, the device being modular and easy to store.

Still another object of the present invention is to provide a line handling device used to facilitate the handling and securing of a mooring line, the device being capable of use with several unaltered mooring lines during a single mooring operation.

A further object of the present invention is to provide a boat hook with telescoping section and a clip internally mounted to extend through an aperture in the boat hook.

Another object of the present invention is to provide a line handling device that is easily attached and removed from any boat hook to facilitate a single clip's use on various line handling devices, as needed.

Still another object of the present invention is to provide a low cost clip that can be used on any diameter boat hook, and any diameter line.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE INVENTION

Although the invention is described in terms of a specific embodiment, it will be readily apparent to those skilled in this art that various modifications, rearrangements and substitutions can be made without departing from the spirit of the invention. The scope of the invention is defined by the claims appended hereto.

Figure 1:
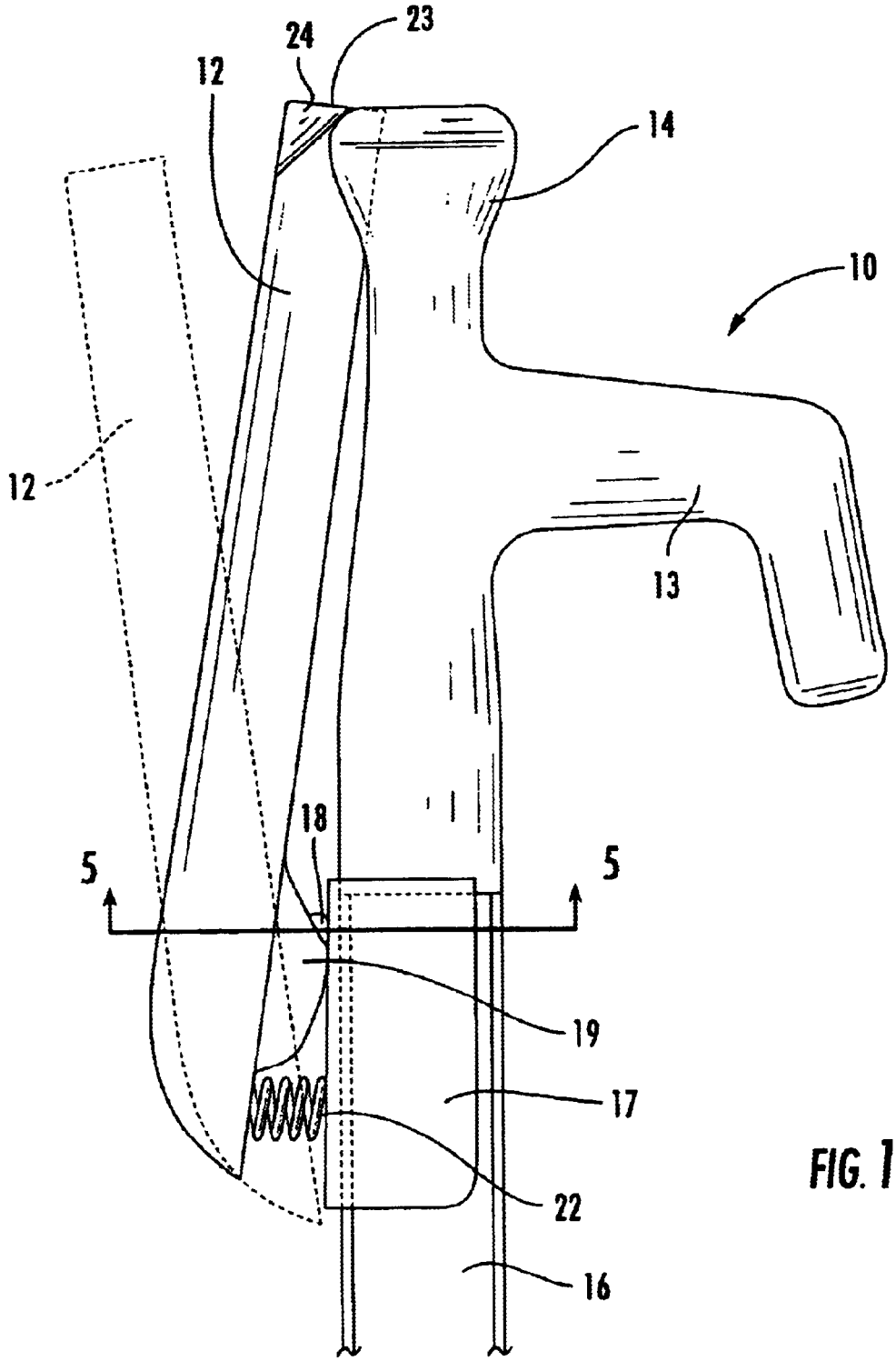
FIG. 1 is a side view of one embodiment of the present invention.
Figure 2:
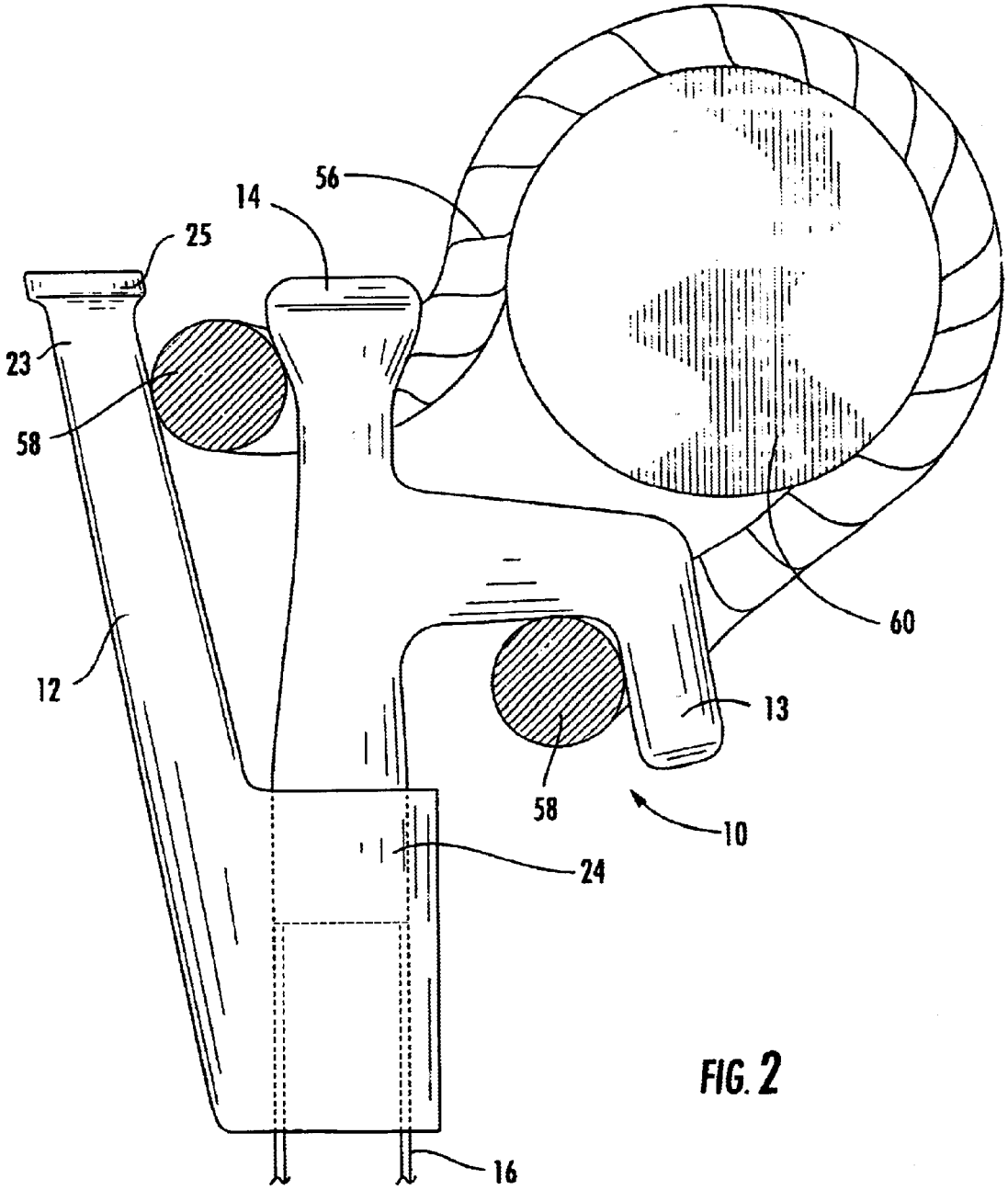
FIG. 2 is a side view of another embodiment of the present invention.

Reference is now made to FIG. 1, wherein the line handling device 10 of the present invention is shown. The device 10 comprises a clip 12 connected to an extendable pole 16 by an attachment. In FIG. 1, the pole is a conventional boat hook with an h shaped portion 13 on the distal end. The clip is shown in phantom lines in the open position. A loop of the mooring line 58 is loosely supported by the distal end of the boat hook such that the shaft of the boat hook forms a rigid diametrical arm, as shown in FIG. 2. An excess of line, greater than the distance between the distal portion of the hook and the clip 12, forms the loop 56. The line is held in an open lasso shape by the h shaped portion 13 and between the clip 12 and the end 14 of the boat hook. The lasso is then manipulated by the boat hook to encircle the piling 60. After the line is placed around the piling, the boat hook is removed from the loop by pulling the boat hook away from the piling to disengage the clip from the line.

Figure 5:
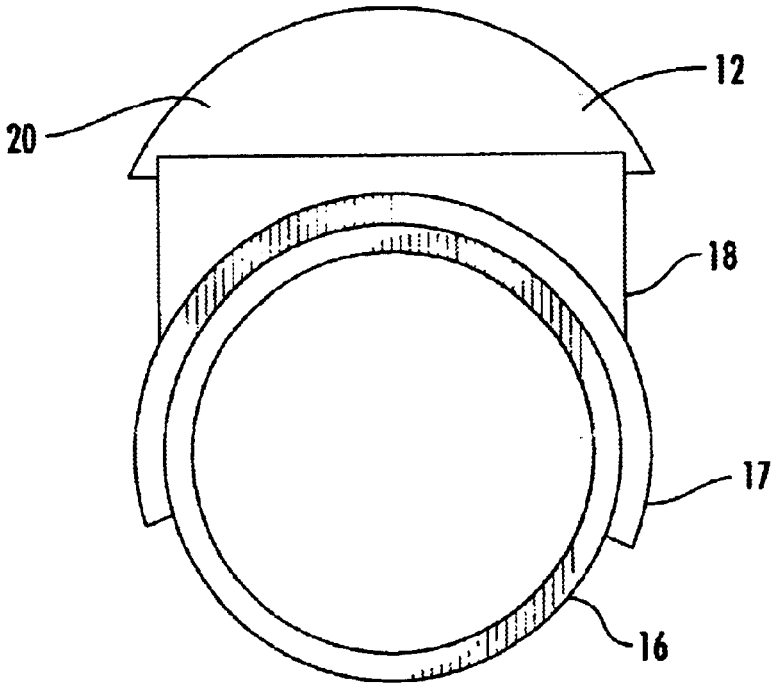
FIG. 5 is a cross section along line 5—5 of FIG. 1.

As shown in FIGS. 1 and 5, the clip 12 is removably connected to the pole 16 by an attachment in the form of a semicircular clamp 17. The clamp may be made of any resilient material with a circumference greater than one-half the circumference of the boat hook shaft. The diameter of the clamp is substantially the same as the diameter of the boat hook shaft, as shown in FIG. 5, so that the resilience of the clamp frictionally secures the clamp to the boat hook. Of course, other fasteners may be incorporated in the clamp 17, such as screws, brads, etc.

The clip 12 has a rounded elongated body 20 that tapers to a smaller apex 23. One surface of the body has a longitudinal groove 21 which accommodates the curvature of the pole 16. The groove 21 may not extend the entire length of the body. The smaller apex 23 is formed with a thickened cross section 24 to reinforce the clip and to serve as a retention device for the line. The thickened cross section 24 has a slightly curved inner surface which provides clearance between the shaft and the clip for ease in feeding the line into the slot between the boat hook and the clip.

The clip 12 is pivotally connected to the clamp 17 by a hinge 19 mounted on a frame 18. Also fixed to the frame 18 is one end of a coil spring 22 which is compressed as the clip 12 is moved away from the shaft of the boat hook. The other end of the coil spring is attached to the end of the clip. The spring adds a resilient grip to the clip for grasping the line 58.

Referring to FIG. 2, the clip 12 is identical in form to the clip shown in the other Figures. The attachment is a circular band 24 that encircles the boat hook shaft. By forcing the band 24 about the shaft of the boat hook, a force fit with a spring bias is effected to connect the clip to the boat hook. The shaft of the boat hook may have a small portion with an enlarged diameter to ensure the force fit. The band 24 may be fixed to the boat hook by mechanical fasteners, adhesives or molding. The clip 12 extends from the band 24 at a fixed angle which will accommodate different sized lines but will hold the line by a wedging action between the boat hook and the clip. The apex 23 of the clip has an enlarged solid plastic end 25 to aid in using the end of the boat hook in the normal fashion, such as fending off.

Figure 3:
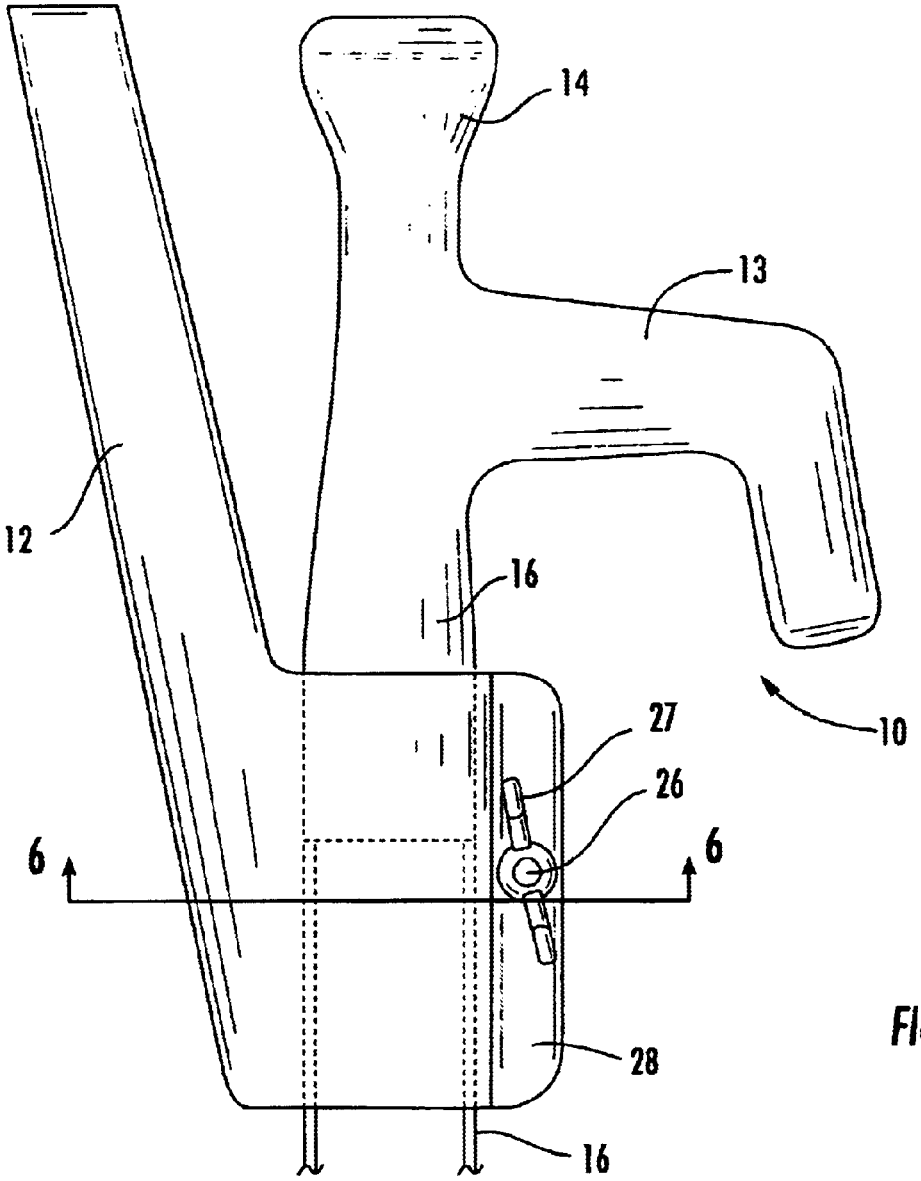
FIG. 3 is a side view of another embodiment of the present invention.
Figure 6:
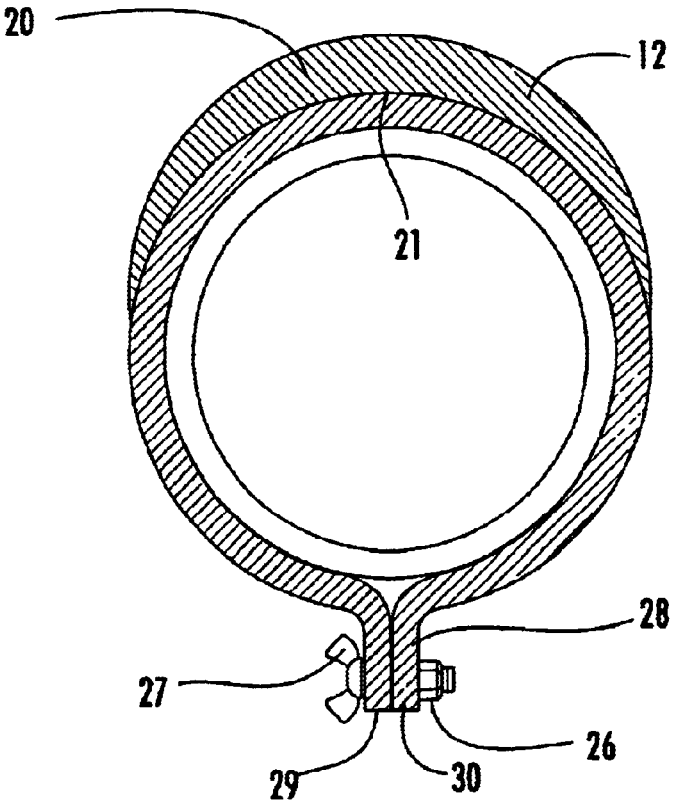
FIG. 6 is a cross section along line 6—6 of FIG. 3.
Figure 7:
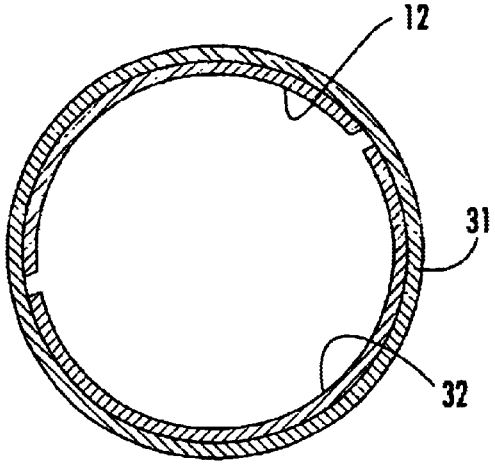
FIG. 7 is a cross section of the embodiment of FIG. 4.
Figure 8:
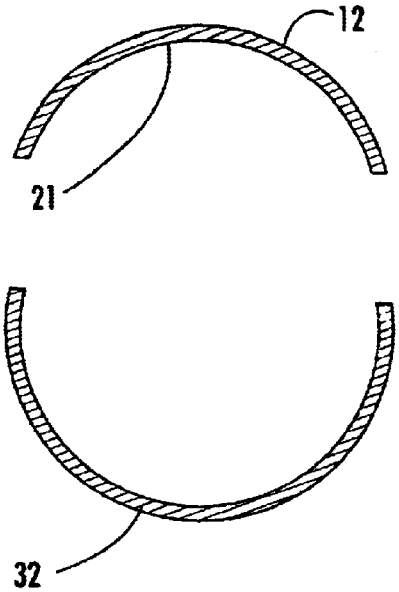
FIG. 8 is a cross section along line 8—8 of FIG. 4.
Figure 9:
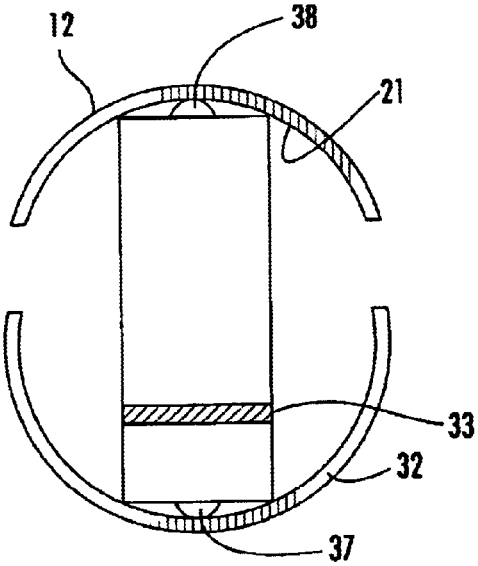
FIG. 9 is a cross section along line 9—9 of FIG. 4.
Figure 10:
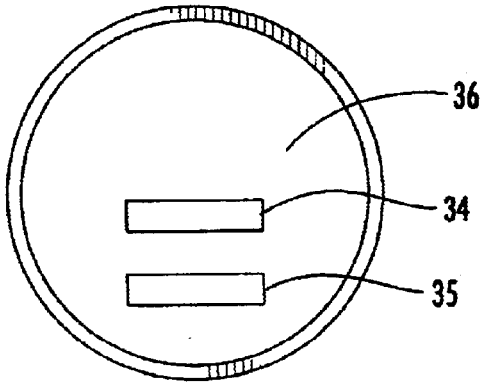
FIG. 10 is a cross section along line 10—10 of FIG. 4.

In FIGS. 3 and 6, clip 12 is attached to the boat hook by a bolt 26 and nut 27 extending through the juxtaposed ends 29 and 30 of a discontinuous band 28. The band 28 may be made of resilient or malleable material to intimately conform to the shaft of the boat hook. The clip 12 may pivot with a spring bias as shown in FIG. 1 or fixed as shown in FIG. 2.

Figure 4:
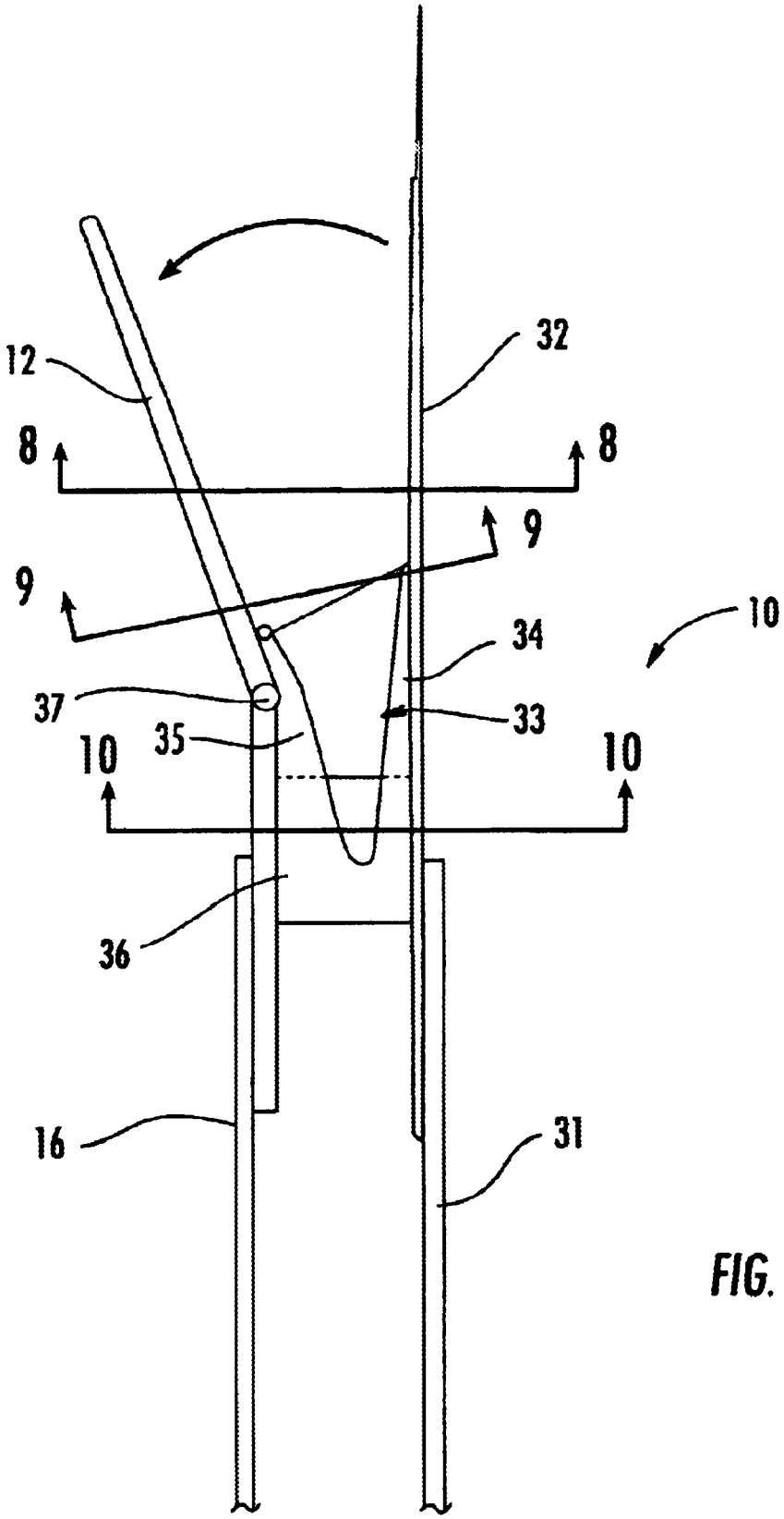
FIG. 4 is a side view partially in section of another embodiment of the present invention.

In the embodiment shown in FIGS. 4, 7, 8, 9, and 10, the clip 12 is mounted on the interior of the boat hook shaft. The extendable pole has an outer tube 31 that telescopes along inner tube 32. Clip 12 is attached by a hinge 37 in the tubular wall of inner tube 32 and forms a pivoting section of the tubular wall. An internal spring 33 biases the clip 12 to move away from the inner tubular wall. As shown in FIG. 4, the spring 33 is a leaf spring in a V-shape with the legs biased to move apart. The ends 34 and 35 of the spring are attached to the tubular wall of tube 32 either permanently or by detents 37 and 38. Tube 32 has a interior plug 36. The base of the V-shaped leaf spring is fixed in the plug to allow the legs 34 and 35 to flex. As the tubes move relative to each other, in one direction, the clip 12 is uncovered and springs outwardly. As the tubes move relative to each other, in the opposite direction, the clip 12 is forced into alignment with the tubular wall of the outer tube 31.

The outer tube 31 may be an integral part of the boat hook shaft or a shorter separate element used to open and close the clip.

In preparation for use of the device 10, the clip 12 is placed on the boat hook with the clip at an acute angle with the shaft of the boat hook. When so positioned, the free end of a docking line is draped over the distal end of the pole and brought back to the clip. The line is then wedged into the slot between the pole and the clip and held in position by the resiliency of the clip fastener.

When a suitable piling or cleat 60 is within line-deployment range, the looped end 56 of the line 58 is placed around the piling or cleat 60. Once the piling or cleat 60 is located within the looped end 56 of the line 58, the device 10 is withdrawn from the piling or cleat 60. Upon withdrawal, the looped end 56 of the mooring line 58 engages the piling 60. The loop end 58 may then be tightened around the piling or cleat 60 by pulling on the non-looped end (not shown) of the mooring line 58. Once the looped end has been drawn tight, the line can then be secured to a boat, not shown, in the normal manner.

After the line has been removed from the clip, the clip may be removed from the pole or boat hook, if desired, and placed in a storage compartment or pocket. Because the clip is unobtrusive and aligned with the shaft of the pole, it may remain secured to the pole.

It is to be understood that while we have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. A line handling device for removable connection to a boat hook shaft in positioning a docking line comprising a clip having an elongated body with a first end and a second end, said clip adapted to be oriented at an angle to the boat hook shaft with said first end displaced from said boat hook shaft, said second end of said clip pivotally connected and spring biased to an attachment, said attachment shaped as a semi-circular clamp adapted to frictionally engage the shaft whereby said clip facilitates positioning of a docking line by maintaining a line loop sized to encircle a piling.

2. An improved boat hook according to claim 1, wherein said attachment is a hinge.

3. An improved boat hook according to claim 2, wherein said clip is spring biased to orient said clip into parallel position relative to said shaft.

4. An improved boat hook according to claim 3, wherein said clamp has a circumference approximating the circumference of the shaft whereby said attachment is removably fixed about said shaft.

5. An improved boat hook and line handling device comprising a boat hook shaft having an outer tube and an inner tube, said outer tube and said inner tube telescoping relative to each other, said outer tube including an opening near one end, said inner tube including a pivoting portion near one end, said pivoting portion having a free end and a fixed end, said free end of said pivoting portion adapted to extend through said opening, said fixed end resiliently attached to said inner tube forming a spring biased clip whereby said clip is oriented parallel to said outer tube when said outer tube and said inner tube are moved relative to each other into one position and oriented at an angle to said first outer tube into another position.

6. An improved boat hook and line handling device for use in positioning a docking line comprising an elongated boat hook shaft and an attachment removably connected about said shaft by friction fit, a clip having an elongated body with a first end and a second end, said clip rigidly oriented at an intersecting angle to said boat hook shaft with said first end displaced from said boat hook shaft, said second end of said clip rigidly connected to said attachment, said attachment encircling said shaft whereby said clip facilitates positioning of a docking line by maintaining a line loop sized to encircle a piling.

* * * * *